US011623832B2

(12) United States Patent
Okamoto et al.

(10) Patent No.: US 11,623,832 B2
(45) Date of Patent: Apr. 11, 2023

(54) SHEET CONVEYER

(71) Applicant: Brother Kogyo Kabushiki Kaisha, Nagoya (JP)

(72) Inventors: Yoshihiro Okamoto, Komaki (JP); Tomoyuki Mizuno, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 188 days.

(21) Appl. No.: 17/130,959

(22) Filed: Dec. 22, 2020

(65) Prior Publication Data

US 2021/0198069 A1 Jul. 1, 2021

(30) Foreign Application Priority Data

Dec. 25, 2019 (JP) ..... JP2019-234162

(51) Int. Cl.
*B65H 7/02* (2006.01)
*B65H 5/06* (2006.01)

(52) U.S. Cl.
CPC ..... *B65H 7/02* (2013.01); *B65H 5/062* (2013.01); *B65H 2511/514* (2013.01); *B65H 2701/1311* (2013.01)

(58) Field of Classification Search
CPC .... B65H 7/02; B65H 5/062; B65H 2511/514; B65H 2701/1311
See application file for complete search history.

(56) References Cited

U.S. PATENT DOCUMENTS 5,988,628 A * 11/1999 Mori ..... B65H 3/0684 271/118
8,056,896 B2 * 11/2011 Oshima ..... H04N 1/0443 399/361
2009/0224462 A1 9/2009 Yamamoto

FOREIGN PATENT DOCUMENTS

JP 2008-228210 A 9/2008
JP 2009-214966 A 9/2009
JP 2013-071831 A 4/2013
JP 2016-011204 A 1/2016

* cited by examiner

*Primary Examiner* — Thomas A Morrison
(74) *Attorney, Agent, or Firm* — Banner & Witcoff, Ltd.

(57) ABSTRACT

A sheet conveyer, having a sheet tray, a tray-driving mechanism, a conveyance guide, a feed roller, a conveyer-driving mechanism, a first sensor, and a controller, is provided. The controller controls the tray-driving mechanism and the conveyer-driving mechanism, during a sequential conveying action, when the first sensor detects an upper-surface level being at a lower limit of a correct range, delay a lift-start timing, at which the tray-driving mechanism starts moving the sheet tray upward, to be later at least than a timing, at which the feed roller after feeding one of the sheets completely and pausing resumes rotating for feeding a next one of the sheets, and cause the sheet tray to complete moving to a higher position prior to completion of feeding of the next sheet.

6 Claims, 7 Drawing Sheets

SHEET CONVEYER

CROSS REFERENCE TO RELATED APPLICATION

This application claims priority from Japanese Patent Application No. 2019-234162, filed on Dec. 25, 2019, the entire subject matter of which is incorporated herein by reference.

BACKGROUND

Technical Field

An aspect of the present disclosure is related to a sheet conveyer.

Related Art

An image scanner having a sheet conveyer, including a sheet tray, a sheet conveyer path, a feeder, a sheet conveyer, and a controller, is known.

The sheet tray may support a sheet of original material to be fed inside a body of the image scanner. The sheet conveyer path may guide the original material being fed inside through a sheet supplying opening. The feeder may include a pickup roller, which may feed the original material supported on the sheet tray along the sheet conveyer path. The sheet conveyer may include a lifting device, which may move the sheet tray vertically.

The pickup roller may be driven by a driving source in the sheet conveyer through an electromagnetic clutch. The lifting device may be driven by a tray-driving motor. The controller may control the driving source and the electromagnetic clutch in the sheet conveyer and the tray-driving motor in the lifting device. The controller may, when performing a sequential conveying action to convey a plurality of sheets of original material supported on the sheet tray one by one sequentially, control behaviors of the driving source and the electromagnetic clutch so that the pickup roller feeding one of the sheets may pause for a short while before starting to convey another one of the sheets.

The image scanner may further include a height-detectable sensor. The height-detectable sensor may detect whether a top-surface level being a height level of an uppermost one of the sheets supported by the sheet tray is at a lower limit of a correct range to feed the sheet along the sheet conveyer path.

During the sequential conveying action, when the height-detectable sensor detects the top-surface level being at the lower limit of the correct range, the controller may control the sheet conveyer and the lifting device so that the sheet tray may start moving upward after the pickup roller stops rotating for a short while and complete the upward movement at an upper position before the pickup roller resumes rotating for feeding a next one of the sheets.

Thus, the pickup roller may be pressed against the uppermost one of the sheets supported by the sheet tray before the pickup roller resumes rotating, and contacting pressure by the pickup roller against the uppermost one of the sheets may be restrained from varying when the pickup roller resumes rotating. Therefore, the pickup roller may deliver stable performance for feeding the sheets.

SUMMARY

In this image scanner, however, the pickup roller may need to wait for the sheet tray to reach the upper position before resuming the rotation. Therefore, the timing to resume rotating may be delayed. In this regard, a runtime for the sequential conveying action may be extended.

In order to restrain the runtime for the sequential conveying action from being extended, the pickup roller may resume rotating before the sheet tray reaches the upper position and completes the upward movement. In such an arrangement, however, the contacting pressure from the pickup roller landing on the uppermost one of the sheets may be unstable, and it may be difficult for the pickup roller to deliver stable performance for feeding the sheets.

The present disclosure is advantageous in that a sheet feeder, which may deliver stable feeding performance, is provided.

According to an aspect of the present disclosure, a sheet conveyer, having a sheet tray, a tray-driving mechanism, a conveyance guide, a feed roller, a conveyer-driving mechanism, a first sensor, and a controller, is provided. The sheet tray is configured to support sheets for being fed. The tray-driving mechanism is configured to move the sheet tray vertically. The conveyance guide is configured guide the sheets fed from the sheet tray. The feed roller is configured to feed the sheets supported by the sheet tray along the conveyance guide by rotating. The conveyer-driving mechanism is configured to drive the feed roller. The conveyer-driving mechanism is configured to, for a sequential conveying action to convey a plurality of ones of the sheets supported by the sheet tray sequentially, cause the feed roller to pause after feeding one of the sheets completely and before starting to feed a next one of the sheets. The first sensor is configured to detect whether a top-surface level being a height level of an uppermost one of the sheets supported by the sheet tray is at a lower limit of a correct range for feeding the sheets along the conveyance guide. The controller is configured to control the tray-driving mechanism and the conveyer-driving mechanism. The controller is configured to, during the sequential conveying action, when the first sensor detects the upper-surface level being at the lower limit of the correct range, delay a lift-start timing, at which the tray-driving mechanism starts moving the sheet tray upward, to be later at least than a timing, at which the feed roller after feeding one of the sheets completely and pausing resumes rotating for feeding the next one of the sheets, and cause the sheet tray to complete moving to a higher position prior to completion of feeding of the next sheet.

BRIEF DESCRIPTION OF THE ACCOMPANYING DRAWINGS

DETAILED DESCRIPTION

In the following paragraphs, described with reference to the accompanying drawings will be embodiments of the present disclosure. It is noted that various connections may be set forth between elements in the following description. These connections in general and, unless specified otherwise, may be direct or indirect and that this specification is not intended to be limiting in this respect. It will be understood that those skilled in the art will appreciate that there are numerous variations and permutations of an image reading apparatus that fall within the spirit and scope of the invention.

First Embodiment

Figure 1:
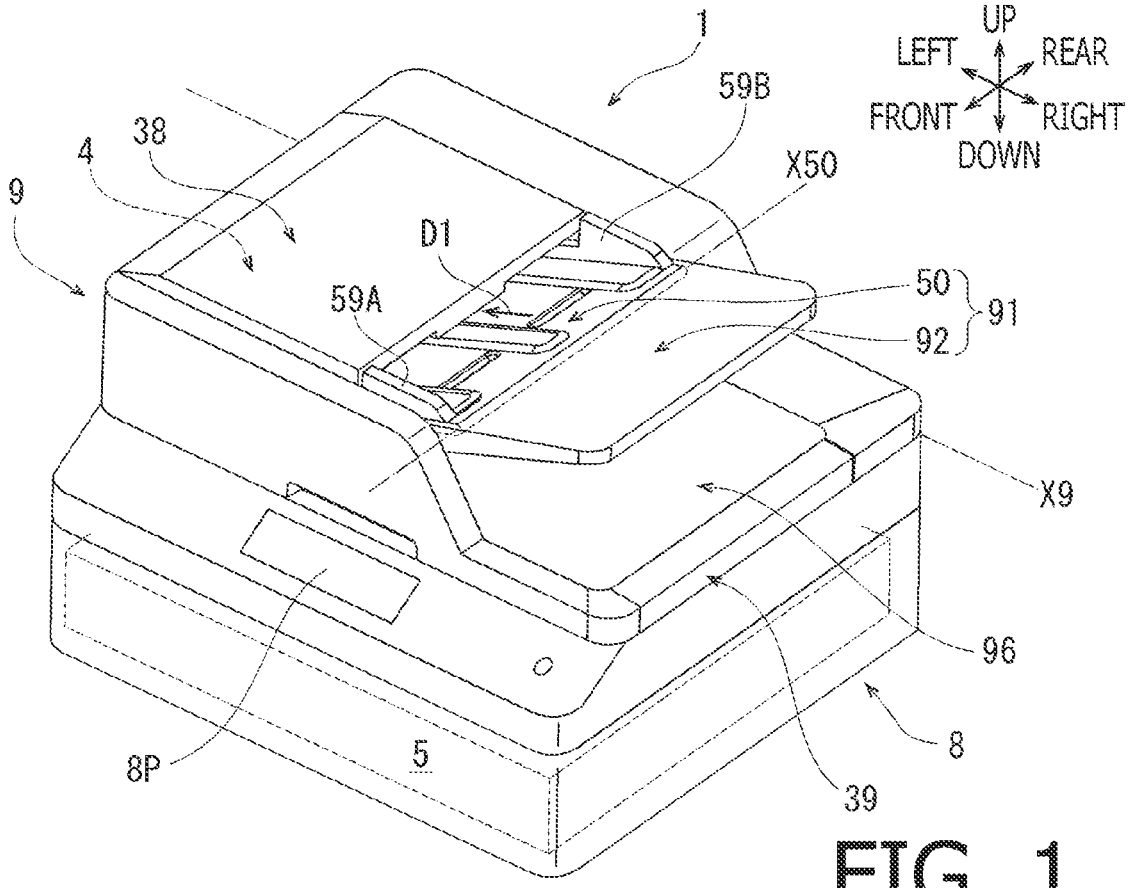
FIG. 1 is a perspective view of an image reading apparatus according to an embodiment of the present disclosure.

FIG. 1 shows an image reading apparatus 1 including a sheet conveyer according to the embodiment of the present disclosure. As shown in FIG. 1, positional relation within the image reading apparatus 1 and each part or item included in the image reading apparatus 1 will be mentioned on basis of the orientation of the image reading apparatus 1 as indicated by arrows in FIG. 1. For example, a side, on which an operation panel 8P is arranged, is defined as a front side of the image reading apparatus 1, and a side opposite to the front side is defined as a rear side. A right-hand side and a left-hand side to a user who faces the front side of the image reading apparatus 1 are defined as a rightward side and a leftward side, respectively. Moreover, a right-to-left or left-to-right direction may be called as a crosswise direction, a front-to-rear or rear-to-front direction may be called as a front-rear direction, and a direction orthogonal to the crosswise direction and to the front-rear direction may be called as an up-down direction or a vertical direction. Furthermore, directions of the drawings in FIGS. 3-6 are similarly based on the orientation of the image reading apparatus 1 as defined above and correspond to those with respect to the image reading apparatus 1 shown in FIG. 1 even when the drawings are viewed from different angles.

<Overall Configuration>

Figure 2:
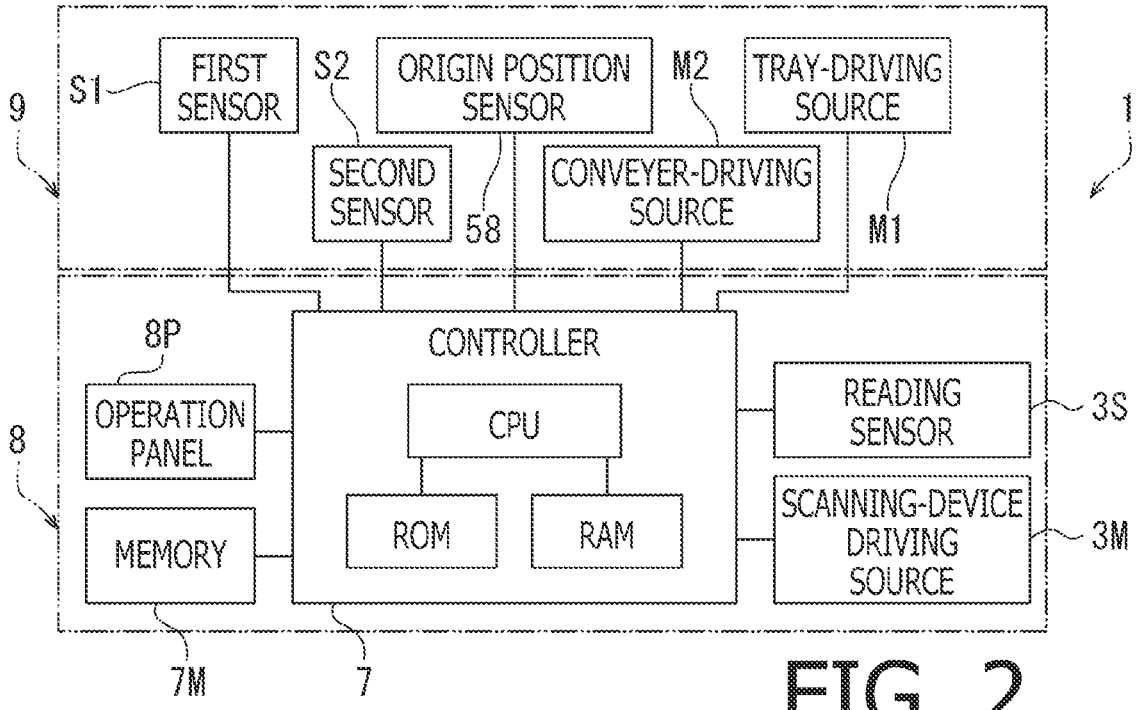
FIG. 2 is a block diagram to illustrate a configuration of the image reading apparatus according to the embodiment of the present disclosure.
Figure 3:
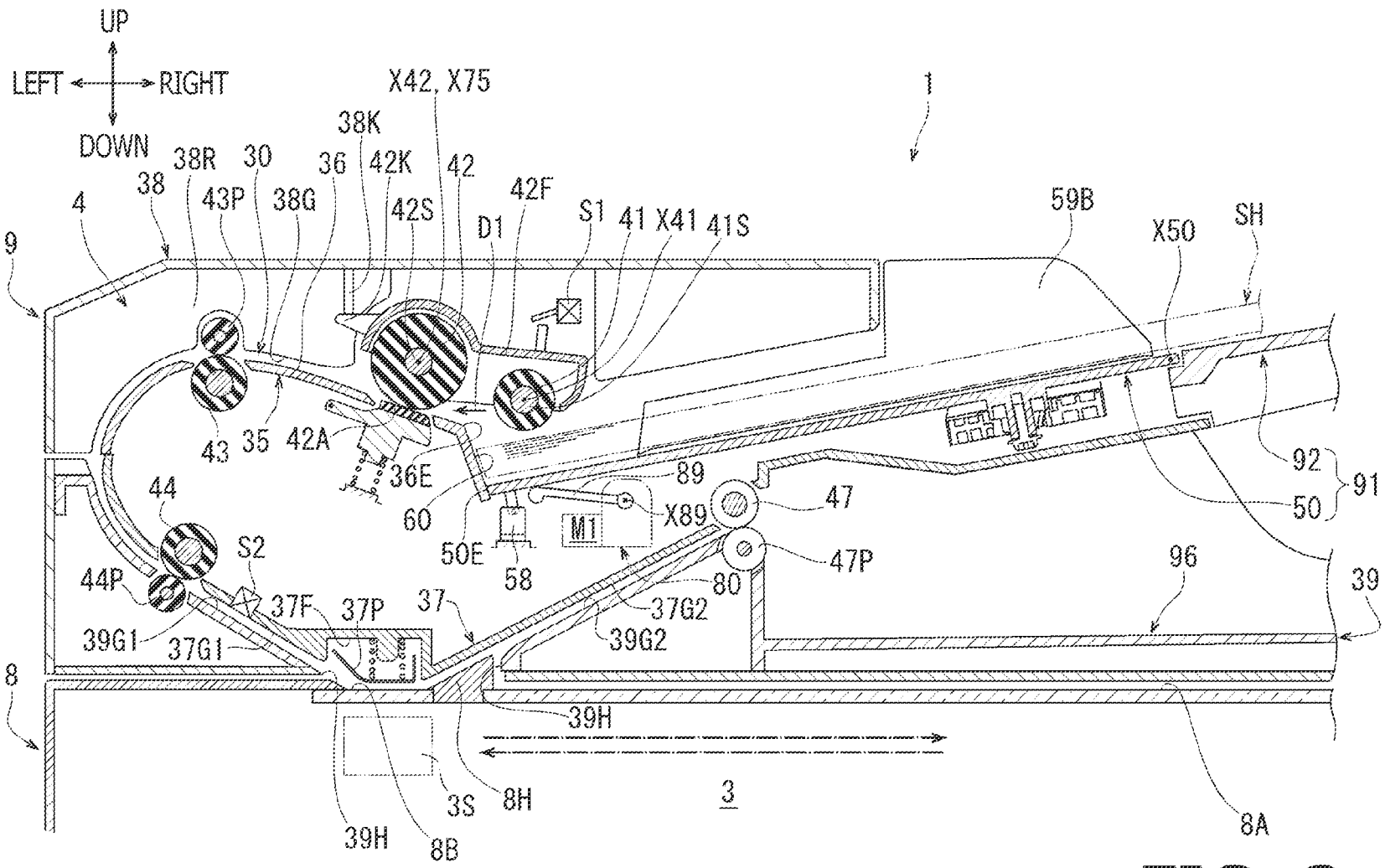
FIG. 3 is a cross-sectional partial view of the image reading apparatus according to the embodiment of the present disclosure, with a movable plate being located at an origin position, and a top-surface level of sheets being lower than a correct range.

As shown in FIGS. 1-3, the image reading apparatus 1 includes a main body 8 and an openable/closable body 9 arranged on top of the main body 8. The main body 8 has an approximate shape of a short rectangular box. On a front side of the main body 8, arranged is the operation panel 8P including a touch panel. In a lower position in the main body 8, stored is an image forming unit 5, which may form an image on a sheet in one of known printing techniques such as inkjet printing and laser printing.

As shown in FIG. 3, in an upper area in the main body 8, arranged is a reader unit 3, which may be used when an image of an original document is read.

Figure 4:
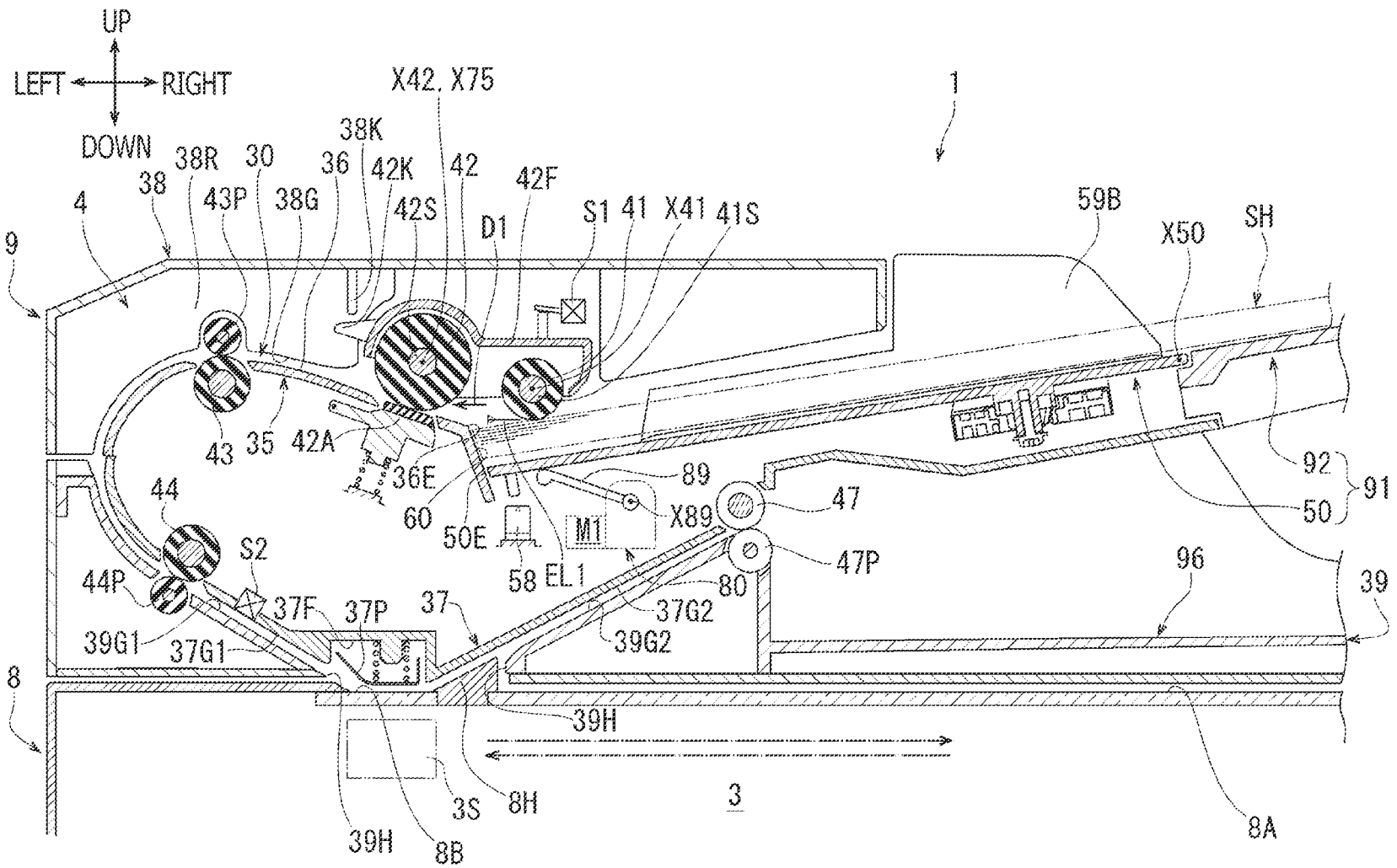
FIG. 4 is another cross-sectional partial view of the image reading apparatus according to the embodiment of the present disclosure, with the movable plate moved upward from the origin position, and the top-surface level of the sheets being in the correct range.
Figure 5:
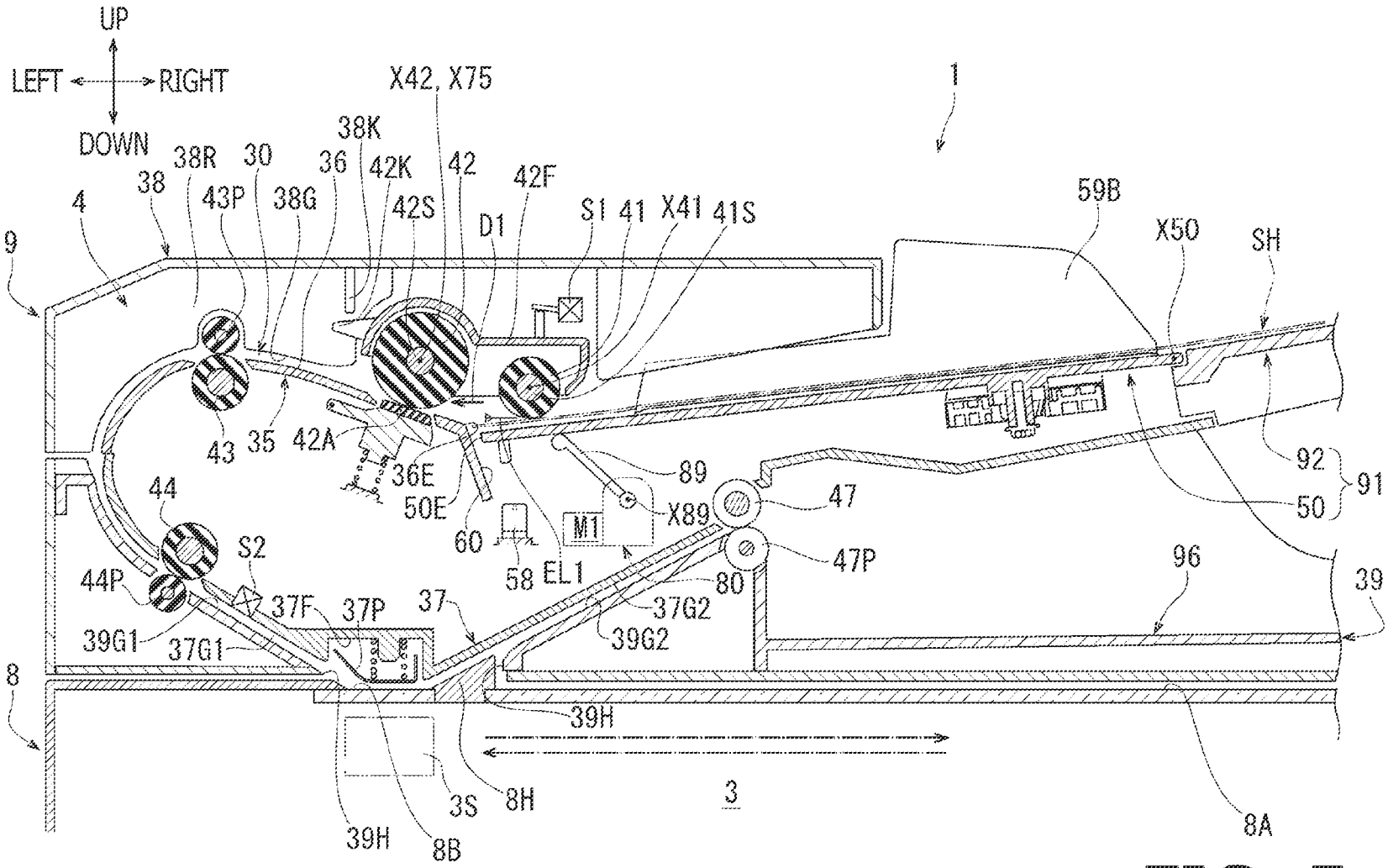
FIG. 5 is another cross-sectional partial view of the image reading apparatus according to the embodiment of the present disclosure, with the movable plate moved upward, to maintain the top-surface level of the sheets within the correct range.

In the openable/closable body 9, arranged are a sheet tray 91, an ejection tray 96, and an auto document feeder 4. The sheet tray 91 and the ejection tray 91 are arranged in a rightward area in the openable/closable body 9. As shown in FIGS. 3-5, the sheet tray 91 supports one or more sheets SH to be fed. The auto document feeder 4 includes a conveyance guide 30 arranged on a downstream side of the sheet tray 91 in a conveying direction D1 to convey the sheets SH. The conveying direction D1 is a direction for each sheet SH to travel along the conveyance guide 30, leftward from the sheet tray 91, turning downward and rightward in a shape of U at a leftward area in the openable/closable body 9, to reach the ejection tray 96.

The auto document feeder 4 may be used when the sheets SH supported on the sheet tray 91 are conveyed one by one in the conveying direction D1 along the conveyance guide 30 so that images of the sheets SH being conveyed are read by the reader unit 3 and ejected to rest on the ejection tray 96.

As shown in FIG. 2, the main body 8 stores a controller 7 and a memory 7M therein. The controller 7 includes a microcomputer including, but not limited to, a CPU, a ROM, and a RAM. The ROM may store programs for controlling actions of the image forming apparatus 1 and for executing a variety of processes. The RAM may serve as a memory area to temporarily store data and signals, which may be used by the CPU to run the programs, and as a work area to process data. The controller 7 may control overall acts in the image reading apparatus 1 including the image forming unit 2, the reader unit 3, the auto document feeder 4, and the operation panel 8P.

The memory 7M is a storage device and may be, for example, a hard disk drive, or a memory card, which may be an external memory device provided separately from the controller 7, or, for another example, a non-volatile memory embedded in the controller 7. The memory 7M may serve as a long-term storage, in which information, data, and setting parameters for executing the programs may be stored in accordance with write-commands from the controller 7, and from which the information may be taken out and passed to the controller 7 according to read-commands from the controller 7.

As shown in FIG. 3, on an upper side of the main body 8, arranged is a platen glass. An upper surface of the platen glass provides a document supporting surface 8A, which occupies a larger area on the upper side of the main body 8. Further, at a leftward position with respect to the document supporting surface 8A on the upper side of the main body 8, arranged is another platen glass. An upper surface of the another platen glass provides a reader surface 8B extending longitudinally in the front-rear direction.

The document supporting surface 8A may support an original document from below when the reader unit 3 reads an image of the original document placed still on the document supporting surface 8A. The original document to be read may include, for example, a sheet, including paper and OHP film, and pages of a book.

The reader surface 8B may contact each of the sheets SH being conveyed one by one by the auto document feeder 4 from below when the reader unit 3 reads images of the sheets SH. At a position on the upper side of the main body 8 between the document supporting surface 8A and the reader surface 8B, arranged is a guiding protrusion 8H. The guiding protrusion 8H may guide the sheet SH being conveyed on the reader surface 8B to lift from the reader surface 8B and turn upper-rightward.

In the present embodiment, an object, whose image may be read by use of the document supporting surface 8A, may be called as an original document, and an object, whose image may be read while the object is being conveyed by the auto document feeder 4, may be called as a sheet. An original document and a sheet may be substantially a same object. In other words, an original document may be used as a sheet, and a sheet may be used as an original document.

As shown in FIG. 1, the openable/closable body 9 is swingably supported by hinges, which are not shown but are arranged at a rear end area of the main body 8, to swing about an open/close axis X9 extending in the crosswise direction. When the openable/closable body 9 is at a closed position, as shown in FIG. 3, the openable/closable body 9 covers the document supporting surface 8A and the reader surface 8B from above. Although not shown in the drawings, the openable/closable body 9 may, with a frontward part thereof being moved to swing upper-rearward about the open/close axis 9A, move to an open position, in which the document supporting surface 8A and the reader surface 8B are exposed. With this swingable structure of the openable/closable body 9, the user may place the original document being the object on the document supporting surface 8A.

In the following paragraphs, positional relation within the openable/closable body 9 and each part or item contained in the openable/closable body 9 will be mentioned on basis of the posture of the openable/closable body 9 being at the closed position.

The reader unit 3 includes a reading sensor 3S, which is stored in an upper area in the main body 8, as shown in FIGS. 2 and 3, a scanning-device driving source 3M, as shown in FIG. 2, and a scanning device to be driven by the scanning-device driving source 3M, which is not shown. The reading sensor 3S may be a known image reading sensor, such as a reader unit combining a reducing optical system and a charge coupled device (CCD) or a contact image sensor (CIS).

As shown in FIG. 3, the reading sensor 3S is located at a lower position with respect to the document supporting surface 8A and the reader surface 8B. The scanning device (not shown) is, in order to read an image of an original document supported on the document supporting surface 8A, driven by the scanning-device driving source 3M to move the reading sensor 3S to reciprocate in the crosswise direction in the area underneath the document supporting surface 8A in the main body 8. On the other hand, in order to read an image of a sheet SH being conveyed by the auto document feeder 4, the scanning device is driven by the scanning-device driving source 3M, and the reading sensor 3S is stopped at a position underneath the reader surface 3B in the main body 8 so that the reader 3S staying still may read an image of a sheet SH being conveyed by the auto document feeder 4. The position where the reading sensor 3S stops underneath the reader surface 3B is a predetermined stationary reading position.

<Configurations of Base Member, First Chute Member, Second Chute Member, and Cover Member>

The openable/closable body 9 includes a base member 39, a first chute member 35, a second chute member 37, and a cover member 38.

The base member 39 forms a bottom part of the openable/closable body 9. A rightward part of the base member 39 forms the ejection tray 96, and in a leftward part of the base member 39, in a range coincident with the reader surface 8B and the guiding protrusion 8H, formed is a reading opening 39H.

A leftward part of the base member 39 with respect to the reading opening 39H forms a conveyer surface 39G1. A leftward part of the conveyer surface 39G1 curves to change an orientation thereof from downward to lower-rightward and extends to incline lower-rightward to a leftward edge of the reading opening 39H.

A rightward part of the base member 39 with respect to the reading opening 39H forms a conveyer surface 39G2. The conveyer surface 39G2 inclines upper-rightward from a position adjacent to the guiding protrusion 8H.

The second chute member 37 is arranged at an upper position with respect to the leftward part of the base member 39. The second chute member 37 is formed to have a pressing-member retainer 37F and guiding surfaces 37G1, 37G2.

The pressing-member retainer 37F is a recessed portion formed to recess upward at a position to face the reader surface 8B. The pressing-member retainer 37F retains a pressing member 37P vertically movably. The pressing member 37P may press the sheet SH being conveyed on the reader surface 8B from above and restrain the sheet SH from being separated from the reader surface 8B.

The guiding surface 37G1 is located at a position leftward with respect to the pressing-member retainer 37F. A leftward part of the guiding surface 37G1 curves along the leftward part of the conveyer surface 39G1 in the base member 39. Moreover, the guiding surface 37G1 inclines lower-rightward along the lower-rightward inclination of the conveyer surface 39G1 in the base member 39.

At an intermediate position on the part of the guiding surface 37G1 inclining lower-leftward, arranged is a second sensor S2. As will be described further below with reference to FIG. 8, the second sensor S2 may detect presence and absence of the sheet SH being conveyed along the conveyance guide 30. When the second sensor S2 is not detecting the presence of the sheet SH, the second sensor S2 may generate and transmit OFF signals indicating a detected result to the controller 7. When the second sensor S2 detects a leading edge of the sheet SH being conveyed along the conveyance guide 30, the second sensor S2 may be switched to generate ON signals and transmit the ON signals to the controller 7 until the sheet SH being conveyed passes through the second sensor S2 completely. After a trailing edge of the sheet SH being conveyed passes through the second sensor S2 completely, the second sensor S2 may generate and transmit OFF signals to the controller 7.

Figure 8:
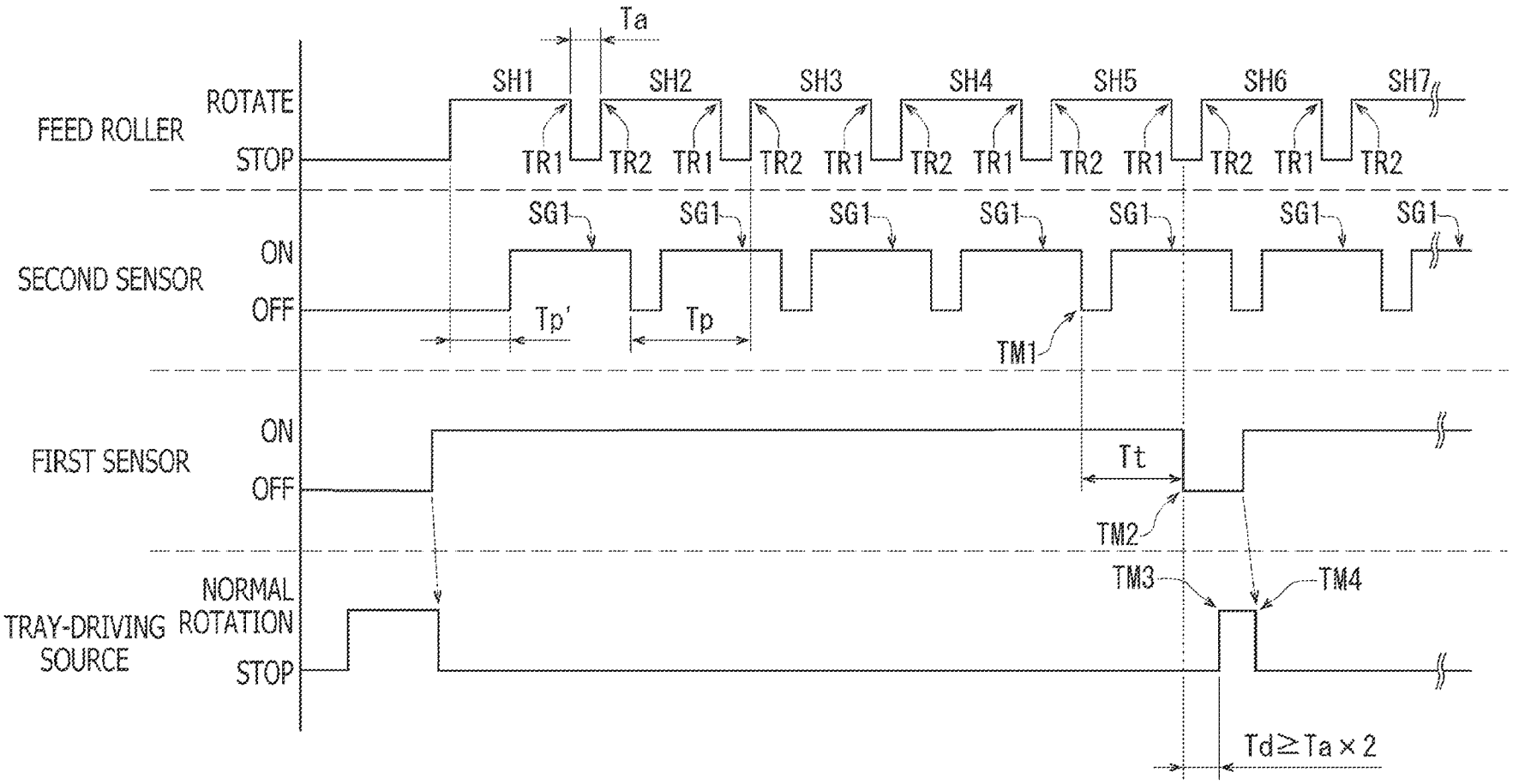
FIG. 8 is a time chart to illustrate timings to move a sheet tray during a sequential conveying action in the image reading apparatus according to the embodiment of the present disclosure.

In other words, while the second sensor S2 detects the sheet SH being conveyed along the conveyance guide 30 from the leading edge to the trailing edge, SH the second sensor S2 may output sheet-detection signals SG1, as shown in FIG. 8.

As shown in FIG. 3, the guiding surface 37G2 is located at a position rightward with respect to the pressing-member retainer 37F. The guiding surface 37G2 inclines upper-rightward along the inclination of the guiding protrusion 8H in the main body 8 and the conveyer surface 39G2 in the base member 39.

The first chute member 35 is arranged at an upper position with respect to the second chute member 37. The first chute member 35 is formed to have a conveyer surface 36 and a restrictive surface 60.

The conveyer surface 36 is located on a downstream side of the sheet tray 91 in the conveying direction D1 and extends upper-leftward. An upstream end of the conveyer surface 36 in the conveying direction D1, i.e., a rightward end of the conveyer surface 36, forms a conveyer edge 36E. A leftward end of the conveyer surface 36 curves to change an orientation thereof from leftward to downward.

The restrictive surface 60 extends downward from the conveyer edge 36E of the conveyer surface 36 in a direction intersecting with the conveying direction D1. The restrictive surface 60 may contact leading edges of the sheets SH supported on the sheet tray 91. A lower end of the restrictive surface 60 is located at a position lower and rightward with respect to the conveyer edge 36E of the conveyer surface 36.

The cover member 38 is arranged at an upper position with respect to the first chute member 35. The cover member 38 includes a plurality of ribs 38R that protrude downward, and lower edges of the ribs 38R form a guiding surface 38G, which virtually spreads along the lower edges of the ribs 38R. In other words, the cover member 38 includes the guiding surface 38G. A rightward part of the guiding surface 38G faces the conveyer surface 36 from above at a position displaced leftward from the conveyer edge 36E of the conveyer surface 36 in the first chute member 35. The guiding surface 38G extends to incline leftward and moderately upward along the conveyer surface 36 in the first chute member 35. A leftward part of the guiding face 38G curves along the leftward part of the conveyer surface 36 in the first chute member 35.

The conveyer surface 36 and the restrictive surface 60 in the first chute member 35, the guiding face 38G in the cover member 38, the conveyer surfaces 39G1, 39G2 in the base member 39, and the guiding surfaces 37G1, 37G2 in the second chute member 37 form a conveyance guide 30.

The conveyer surfaces 36, 39G1, 39G2, and the guiding surfaces 38G, 37G1, 37G2 extend along the conveying direction D1 and define a conveyer path, in which the sheets SH are conveyed from the sheet tray 91 to the ejection tray 96.

<Configuration of Sheet Tray>

As shown in FIGS. 1 and 3, the sheet tray 91 is supported by side frames, which are not shown but are arranged on the frontward side and the rearward side of the openable/closable body 9, to be arranged at an upper position with respect to the ejection tray 96 to vertically overlap the ejection tray 96.

The sheet tray 91 includes a sheet tray body 92 and the movable plate 50. The sheet tray body 92 extends from a rightward area in the openable/closable body 9 to incline moderately lower-leftward. The movable plate 50 is arranged to adjoin a leftward end portion of the sheet tray body 92. The movable plate 50 extends substantially in a plane toward the restrictive surface 60 in the first chute member 35.

A leftward part of the movable plate 50 is covered by a rightward part of the cover member 38 from above. The sheet tray 91 supports the sheets SH to be fed inside on the sheet tray body 92 and the movable plate 50.

The movable plate 50 is pivotably supported by side frames, which are not shown, to pivot about a pivot axis X50 extending in the front-rear direction, as shown in FIGS. 3-5. In other words, the sheet tray 91 includes the movable plate 50, which is pivotable and thereby the sheet tray 91 is movable vertically.

The movable plate 50 includes a facing end 50E. The facing end 50E forms an end of the movable plate 50 on a downstream side in the conveying direction D1 and faces the restrictive face 60.

When the movable plate 50 is at the position shown in FIG. 3, the facing end 50E faces a part of the restrictive face 60 closer to the lower end. When the movable plate 50 is at a position shown in FIG. 5, the facing end 50E faces another part of the restrictive face 60 closer to the conveyer edge 36E of the conveyer surface 36. In other words, the facing end 50E continues facing the restrictive surface 60 regardless of the pivoting movements of the movable plate 50.

The position of the movable plate 50 shown in FIG. 3 is an origin position. At a position in the vicinity of the lower end of the restrictive surface 60, arranged is an origin position sensor 58. The origin position sensor 58 may detect the movable plate 50 located at the origin position, and when the origin position sensor 58 detects the movable plate 50 located at the origin position, the origin position sensor 58 may transmit ON signals to the controller 7. On the other hand, when the movable plate 50 moves upward from the origin position, as shown in FIGS. 4 and 5, the origin position sensor 58 may transmit OFF signals to the controller 7.

As shown in FIGS. 1 and 3, on the movable plate 50, arranged are two width-restrictive guides 59A, 59B, which are slidable in the front-rear direction. The width-restrictive guides 59A, 59B, which are located frontward and rearward, respectively, may be moved to be closer to or farther from each other so that the width-restrictive guides 59A, 59B may flank the sheets SH to support the sheets SH steadily, regardless of a width of the sheets SH on the sheet tray 91, at a position centered about a center of the sheet tray 91 in a widthwise direction, which coincides with the front-rear direction.

<Configuration of Tray-Driving Mechanism>

The auto document feeder 4 includes a tray-driving mechanism 80, which may move the movable plate 50 of the sheet tray 91 vertically according to a quantity of the sheets SH placed on the sheet tray 91. The tray-driving mechanism 80 is arranged on a lower side of the movable plate 50. The tray-driving mechanism 80 includes a tray-driving source M1, a link lever 89, and a plurality of gears, which are not shown but may transmit a driving force of the tray-driving source M1 to the link lever 89.

The tray-driving source M1 may be, for example, a motor and is rotatable bidirectionally, i.e., in a normal direction and a reverse direction, under the control of the controller 7 to produce a driving force. The link lever 89 is pivotably supported to pivot about a pivot axis X89, which extends in the front-rear direction. The link lever 89 projects upper-leftward from the pivot axis X89, and a tip end of the link lever 89 contacts a downward surface of the movable plate 50.

With the tray-driving mechanism 80 that may move the movable plate 50, the movable plate 50 located at the origin position may be detected by the origin position sensor 58. The origin position sensor 58 detecting the movable plate 50 at the origin position may transmit ON signals to the controller 7, and the controller 7 receiving the detection signals may stop the tray-driving source M1 so that the movable plate 50 may be maintained at the origin position.

As the tray-driving source M1 rotates in the normal direction, the driving force of the tray-driving source M1 may be transmitted to the link lever 89, and the link lever 89 may pivot upward and push the movable plate 50 upward. Accordingly, the movable plate 50 may pivot about the pivot axis X50 to move upward from the position shown in FIG. 3 to a position shown in FIG. 4 or further to a position shown in FIG. 5.

On the other hand, when the tray-driving source M1 rotates in the reverse direction, the driving force of the tray-driving source M1 may be transmitted to the link lever 89 so that the link lever 89 may pivot downward, and the movable plate 50 accompanying with the link lever 89 may descend. Accordingly, the movable plate 50 may pivot about the pivot axis X50 to move downward from the position shown in FIG. 5 through the position shown in FIG. 4 to return to the origin position shown in FIG. 3.

<Configuration of Feed Roller, Separation Roller, and Separation Pad>

As shown in FIG. 3, the auto document feeder 4 includes the feed roller 41, the separation roller 42, and a separation pad 42A.

The separation roller 42 is arranged at a position on a downstream side with respect to the conveyer edge 36E of the conveyer surface 36 in the first chute member 35 in the conveying direction D1 and an upper position with respect to the conveyer surface 36. The separation pad 42A is supported by the first chute member 35 at a position directly below the separation roller 42 in an arrangement to be exposed from the conveyer surface 36. The separation pad 42A is urged toward the separation roller 42.

A rotation shaft 42S of the separation roller 42 supports a holder 42F pivotably. The holder 42F is swingable about a swing axis X42, which is a rotation axis of the rotation shaft 42S. The holder 42F is arranged to extend rightward from the rotation shaft 42S over the conveyer edge 36E of the conveyer surface 36.

The feed roller 41 is retained rotatably at a rightward portion of the holder 42F. The feed roller 41 is arranged at a position to face the movable plate 50 from above. The feed roller 41 is movable in the vertical direction along with pivoting motions of the holder 42F about the swing axis X42.

On a leftward end of the holder 42F, formed is a restrictive protrusion 42K protruding leftward. Meanwhile, on the cover member 38, at an upper position with respect to the restrictive protrusion 42K, formed is a restricting portion 38K being a rib protruding downward.

The restricting portion 38K may contact the restrictive protrusion 42K from above to restrict a swingable angle of the holder 42F. Thus, a lower-limit position of the feed roller 41 may be defined. The feed roller 41 may contact the movable plate 50 of the sheet tray 91 or the sheet SH supported on the sheet tray 91 and may be uplifted by the sheet tray 91 or the sheet SH to move from the lower-limit position as shown in FIG. 3 to the position shown in FIG. 4 or FIG. 5. When the feed roller 41 is uplifted, on the other hand, the restrictive protrusion 42K may be lowered and separate from the restricting portion 38K.

As shown in FIG. 3, the origin position for the movable plate 50 of the sheet tray 91 is lower than the lower-limit position for the feed roller 41 and is a position, at which clearance to accept a largest allowable quantity of sheets SH may be reserved. In other words, the origin position for the movable plate 50 is a position, at which the sheet tray 91 may support the sheets SH.

In the openable/closable body 9, at an upper position with respect to the holder 42F, arranged is a first sensor S1. The first sensor S1 may detect a posture of the holder 42F when a lower end of the feed roller 41 contacts an uppermost sheet SH in the sheets SH on the sheet tray 91; thereby, the first sensor S1 may indirectly detect whether a top-surface level, which is a height level of an uppermost one of the sheets SH supported by the sheet tray 91, is at a lower limit EL1 of a correct range for the sheet SH to be fed along the conveyance guide 30 correctly.

The top-surface level is a height level of a part of the uppermost one of the sheets SH supported by the sheet tray 91, at which the lower end the feed roller 41 contacts the uppermost sheet SH. The correct range may be a range, in which a difference in height between the uppermost sheet SH and the conveyer edge 36E of the conveyer surface 36 may not interfere with the uppermost sheet SH being forwarded to the conveyer surface 36. The holder 42F and the feed roller 41 shown in FIGS. 4 and 5 are in exemplary position, in which the top-surface level is at the lower limit EL1 of the correct range.

When the top-surface level is at a position lower than the lower limit EL1 of the correct range, as shown in FIG. 8, the first sensor S1 may transmit the OFF signals to the controller 7. Under the control of the controller 7 receiving the OFF signals, the movable plate 50 may be moved upward, and when the top-surface level is lifted to a position higher than the lower limit EL1 of the correct range, the first sensor S1 may switch the signals to the controller 7 from the OFF signals to the ON signals. Thereafter, as the sheets SH supported by the sheet tray 91 are reduced by, for example, being fed one after another, the top-surface level may descend. When the descending top-surface level reaches the lower limit EL1 of the correct range, the first sensor S1 may switch the signals to the controller 7 from the ON signals to the OFF signals.

Meanwhile, based on the timing, in which the signals received from the first sensor S1 are switched from the OFF signals to the ON signals, the controller 7 may determine that the top-surface level is lifted upward to be higher than the lower limit EL1 of the correct range.

On the other hand, based on the timing, in which the signals received from the first sensor S1 are switched from the ON signals to the OFF signals, the controller 7 may determine that the top-surface level descended and reached the lower limit EL1 of the correct range.

<Configurations of First and Second Conveyer Rollers and Ejection Roller>

As shown in FIG. 3, the auto document feeder 4 includes a first conveyer roller 43, a first pinch roller 43P, a second conveyer roller 44, a second pinch roller 44P, an ejection roller 47, and an ejection pinch roller 47P.

The first conveyer roller 43 is supported by the first chute member 35, at an intermediate position in the conveyer surface 36 in the conveying direction D1. The first pinch roller 43P is supported by the cover member 38 at a position on the guiding surface 38G and is urged toward the first conveyer roller 43.

The second conveyer roller 44 is supported by the second chute member 37, at a position upstream from the second sensor S2 in the guiding surface 37G1 in the conveying direction D1. The second pinch roller 44P is supported by the base member 39 at a position on the conveyer surface 39G1 and is urged toward the second conveyer roller 44.

The ejection roller 47 is supported by the second chute member 37 at a position in a rightward end area in the guiding surface 37G2. The ejection pinch roller 47P is supported by the base member 39 at a position in a rightward end area in the conveyer surface 39G2 and is urged toward the ejection roller 47.

<Configuration of Conveyer-Driving Mechanism>

Figure 6:
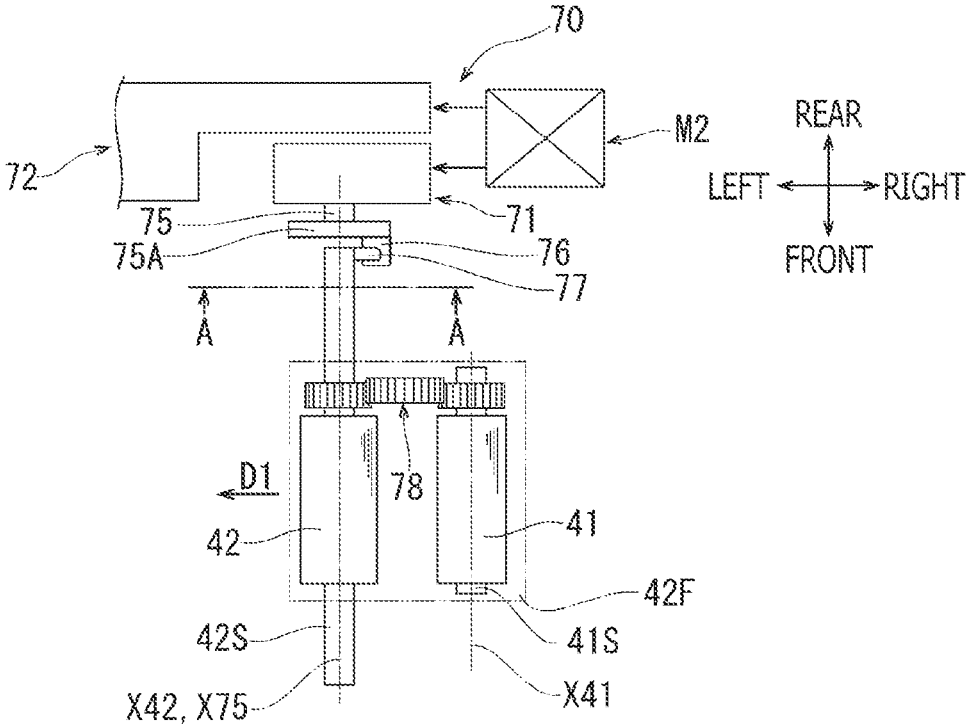
FIG. 6 is an illustrative top plan view of a conveyer-driving source, a first driving train, and a second driving train in the image reading apparatus according to the embodiment of the present disclosure.

As shown in FIG. 6, the auto document feeder 4 includes a conveyer-driving mechanism 70, which may drive the feed roller 41, the separation roller 42, the first conveyer roller 43, the second conveyer roller 44, and the ejection roller 47. The conveyer-driving mechanism 70 includes a conveyer-driving source M2, a first driving train 71, and a second driving train 72.

The conveyer-driving source M2 may be, for example, a motor. The conveyer-driving source M2 may rotate under the control of the controller 7 to produce a driving force. The first driving train 71 forms a path to transmit the driving force of the conveyer-driving source M2 to the feed roller 41 and the separation roller 42. The first driving train 71 includes the rotation shaft 42S of the separation roller 42, a transmission shaft 75 arranged closer to the conveyer-driving source M2 than the rotation shaft 42S, a disc 75A, a transmission-active portion 76, a transmission-passive portion 77, and a gear train 78. The gear train 78 is arranged closer than the rotation shaft 42S to the feed roller 41.

A transmission axis X75 of the transmission shaft 75 coincides with the swing axis X42 of the rotation shaft 42S. At a frontward end of the transmission shaft 75, the disc 75A is fixed integrally with the transmission shaft 75. Between the disc 75A and a rearward end of the rotation shaft 42S, clearance is reserved. The feed roller 41 is integral with the rotation shaft 41S and rotates about a rotation axis X41. The separation roller 42 is integral with the rotation shaft 42S and rotates about the swing axis X42.

As shown in FIG. 6 and FIGS. 7A-7C, the transmission-active portion 76 may be a protrusion protruding frontward at an outer circumferential edge of the disc 75A. The transmission-active portion 76 may rotate integrally with the transmission shaft 75 and the disc 75A about the transmission axis X75 by the driving force of the conveyer-driving source M2 transmitted to the transmission shaft 75.

The transmission-passive portion 77 is a protrusion protruding outward in a radial direction of the transmission axis X75 from the rotation shaft 42S at a rearward end of the rotation shaft 42S and may rotate integrally with the rotation shaft 42S about the transmission axis X75. The transmission-passive portion 77 may contact the transmission-active portion 76 in a circumferential direction of the transmission axis S75.

Figures 7A, 7B, 7C:
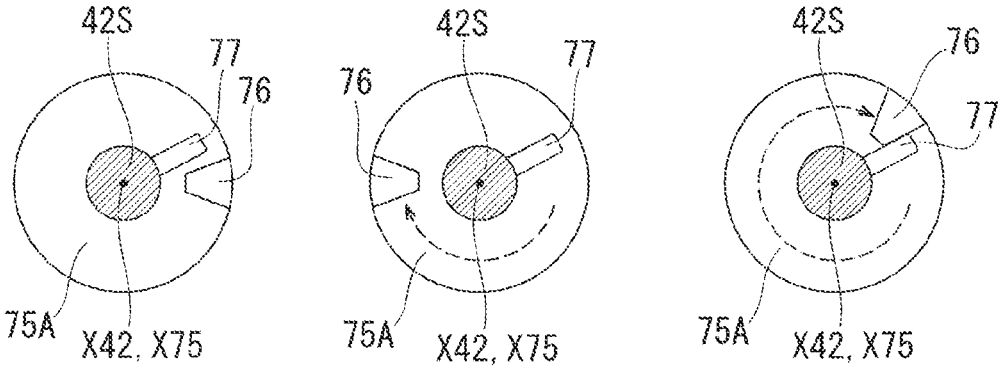
FIGS. 7A-7C are cross-sectional views viewed at a cross section A-A shown in FIG. 6 illustrating transition of positional relation between a transmission-active portion and a transmission-passive portion in the image reading apparatus according to the embodiment of the present disclosure.

As the rotation shafts 42S rotates, as shown in FIGS. 7A-7B, the transmission-passive portion 77 may separate from the transmission-active portion 76 in the circumferential direction of the transmission axis X75. While the transmission-passive portion 77 is apart from the transmission-active portion 76, the driving force of the conveyer-driving source M2 is not transmitted to the transmission-passive portion 77. When the transmission-passive portion 77 contacts the transmission-active portion 76 in the circumferential direction of the transmission shaft X76, on the other hand, as shown in FIG. 7C, the driving force of the conveyer-driving source M2 may be transmitted to the transmission-passive portion 77, and the transmission-passive potion 77 being pushed by the transmission-passive portion 77 may start rotating passively delaying from the transmission-active portion 76 for an amount less than one lap.

As shown in FIG. 6, the gear train 78 is arranged inside the holder 42F. The gear train 78 may transmit the rotation of the rotation shaft 42S to the rotation shaft 41S.

Thus, the feed roller 41 and the separation roller 42 may rotate by the driving force of the conveyer-driving source M2 being transmitted to the feed roller 41 and the separation roller 42 through the first driving train 71 and the gear train 78. A conveying velocity to convey the sheet SH by the feed roller 41 and the separation roller 42 may be called as conveying velocity V1. In other words, the feed roller 41 and the separation roller 42 may convey the sheet SH at the conveying velocity V1.

The feed roller 41 may, as shown in FIG. 4, rotate in a direction to feed the uppermost sheet SH among the sheets SH supported on the sheet tray 91 toward the conveyer surface 36 of the conveyance guide 30.

The separation roller 42 may apply a conveying force directed downstream in the conveying direction D1 to the sheet SH that reached a nipping position between the separation roller 42 and the separation pad 42A. The separation pad 42A may, when two or more sheets SH are conveyed to the nipping position, apply a force to stop the sheet(s) SH other than the sheet SH that contacts the separation roller 42.

As illustrated in a partly omitted form in FIG. 6, the second driving train 72 forms a path to transmit the driving force of the conveyer-driving source M2 to the first conveyer roller 43, the second conveyer roller 44, and the ejection roller 47. The second driving train 72 includes a plurality of gears, which are each fixed to one of the first conveyer roller 43, the second conveyer roller 44, and the ejection roller 47, to integrally rotate with the first conveyer roller 43, the second conveyer roller 44, and the ejection roller 47, respectively.

Thus, the first conveyer roller 43, the second conveyer roller 42, and the ejection roller 47 may rotate by the driving force of the conveyer-driving source M2 being transmitted through the second driving train 72 to the first conveyer roller 43, the second conveyer roller 42, and the ejection roller 47.

A conveying velocity to convey the sheet SH by the first conveyer roller 43, the second conveyer roller 44, and the ejection roller 47 may be called as conveying velocity V2. In other words, the first conveyer roller 43, the second conveyer roller, and the ejection roller 47 may convey the sheet SH at the conveying velocity V2. In the conveyer-driving mechanism 70, a reduction rate of the first driving train 71 and a reduction rate of the second driving train 72 are in a setting such that the conveying velocity V2 is higher than the conveying velocity V1.

As shown in FIG. 4, the first conveyer roller 43 may, together with the first pinch roller 43P, nip the sheet SH separated from the other sheets SH by the separation roller 42 and the separation pad 42A and convey the separated sheet SH passed from the separation roller 42 and the separation pad 42A toward the second conveyer roller 44 and the second pinch roller 44P.

The second conveyer roller 44 may, together with the second pinch roller 44P, nip the sheet SH conveyed by the first conveyer roller 43 and the first pinch roller 43P and convey the sheet SH toward the reader surface 8B, i.e., toward the reading sensor 3S staying still at the stationary reading position.

The ejection roller 47 may, together with the ejection pinch roller 47P, nip the sheet SH passing over the reader surface 8B and being guided by the conveyer surface 39G2 and the guiding surface 37G2 and eject the sheet SH at the ejection tray 96.

An action involving the conveyer-driving mechanism 70 to convey a plurality of sheets SH supported by the sheet tray 91 one by one sequentially under the control of the controller 7 controlling the conveyer-driving source M2 will be herein called as a sequential conveying action.

Meanwhile, an action involving the conveyer-driving mechanism 70 to convey solely one of the sheets SH supported by the sheet tray 91 may be regarded as merely conveying a first one of the sheets SH in the sequential conveying action and ending the sequential conveying action thereat; therefore, description for the single, or non-sequential, conveying action is herein omitted.

The conveyer-driving mechanism 70 performing the sequential conveying action may, after feeding one of the sheets SH through the feed roller 41 and the separation roller 42, cause the feed roller 41 and the separation roller 42 to stop rotating temporarily before starting to feed a next one of the sheets SH.

Therefore, while the conveyer-driving source M2 is in motion, the transmission-active portion 76 and the transmission-passive portion 77 in the first driving train 71 may repeat contacting and separating from each other. Therefore, the feed roller 41 and the separation roller 42 may shift first through third states in circulation: a first state, in which the feed roller 41 and the separation roller 42 convey the sheet SH from the sheet tray 91 along the conveyance guide 30 at the conveying velocity V1; a second state, in which the feed roller 41 and the separation roller 42 are rotated passively by the sheet SH being nipped and pulled by the first conveyer roller 43 at the conveying velocity V2; and a third state, in which the feed roller 41 and the separation roller 42 stop rotating due to separation of the sheet SH being pulled by the first conveyer roller 43 from the feed roller 41 and the separation roller 42. In the first state, the transmission-active portion 76 and the transmission-passive portion 77 being pushed by the transmission-active portion 76 rotate integrally, as shown in FIG. 7C. In the second state, the transmission-passive portion 77 rotates at the conveying velocity V2, and the transmission-active portion 76 rotates at the conveying velocity V1; therefore, the transmission-passive portion 77 separates gradually farther from the transmission-active portion 76, and a circumferential distance between the transmission-passive portion 77 and the transmission-active portion 76 gradually increases. In the third state, after the sheet SH leaves the separation roller 42, the transmission-passive portion 77 stops rotating. However, in order to continue conveyance of the sheets SH, rotation of the transmission-active portion 76 is maintained. In the meantime, the driving force of the conveyer-driving source M2 may not be transmitted to the transmission-passive portion 77 until the transmission-active portion 76 catches up and contacts the transmission-passive portion 77. Therefore, until the transmission-active portion 76 contacts the transmission-passive portion 77, feeding of the next sheet SH may not start.

While the sheet SH is being conveyed by the first conveyer roller 43 at the conveying velocity V2, the transmission-active portion 76 may continue to drive the feed roller 41 and the separation roller 42 at the conveying velocity V1. However, the feed roller 41 and the separation roller 42 may be driven by the sheet SH being pulled at the conveying velocity V2. Therefore, the transmission-passive portion 77 may separate from the transmission-active portion 76 gradually leaving the transmission-active portion 76 behind. Thereafter, when the sheet SH leaves the separation roller 42, the feed roller 41 and the separation roller 42 may stop rotating to pause motionless until the transmission-active portion 77 catches up with the transmission-passive portion 76.

Accordingly, as the sheets SH are fed one after another from the sheet tray 91 by the feed roller 41, a distance may be securely reserved between the sheets SH, e.g., SH1, SH2 . . . , SH7, as shown in FIG. 8.

In this arrangement, a length of a time period, in which the feed roller 41 and the separation roller 42 pause motionless, may be based on a calculation: dividing a difference between the conveying velocity V1 and the conveying velocity V2 by the conveying velocity V1, and multiplying the quotient by a time length, in which the sheet SH is conveyed at the conveying velocity V2. Therefore, the length of the pausing period, in which the feed roller 41 and the separation roller 42 pause motionless, depends on a length of the sheet SH being conveyed.

A timing, at which the feed roller 41 stops rotating to spare the pausing period, may be called as a rotation-stop timing TR1. A timing, at which the feed roller 41 resumes rotating after pausing motionless for the pausing period, may be called as a rotation-resume timing TR2. The pausing period, between the rotation-stop timing TR1 and the rotation-resume timing TR2, may be called as a third time Ta.

The controller 7 may, when starting the sequential conveying action with the conveyer-driving mechanism 70, obtain an output time being a length of a time period, in which the sheet-detection signals SG1 for a first sheet SH (SH1) are output from the second sensor S2.

Meanwhile, the memory 7M stores information concerning a distance of a section in the conveyance guide 30 between an upstream end of the conveyance guide 30 and the second sensor S along the conveying direction D. Moreover, the memory 7M stores information concerning the conveying velocities V1, V2.

Based on the output time of the sheet-detection signals SG1 and with reference to the distance of the section in the conveyance guide 30 and the conveying velocities V1, V2, the controller 7 may determine a sheet length LS1, which is a length of the sheet SH being conveyed along the conveyance guide 30.

The memory 7M further stores a data table, in which lengths of various sheets SH conveyable in the image reading apparatus 1 and the third time Ta for each of the lengths are related.

Based on the sheet length LS1 and with reference to the data table in the memory 7M, the controller 7 may obtain the third time Ta.

Moreover, the controller 7 may, when starting the sequential conveying action with the conveyer-driving mechanism 70, obtain an elapsed time Tp', which is a length of a time period between activation of the conveyer-driving source M2 for the sequential conveying action and a timing when the second sensor S2 starts outputting the sheet-detection signals SG1 for the first sheet SH (SH1).

The controller 7 may calculate a first time Tp being a length of a time period between a timing when the second sensor S2 stops outputting the sheet-detection signals SG1 and the rotation-resume timing T2, at which the feed roller 41 resumes rotating.

While the sequential conveying action with the conveyer-driving mechanism 70 is being performed, a timing, at which the first sensor S1 detects the top-surface level reaching the lower limit EL of the correct range, in other words, when the signals from the first sensor S1 are switched from the ON signals to the OFF signals, will be called as a second timing TM2.

Meanwhile, a timing, at which the second sensor S2 stops outputting the sheet-detection signals SG1 immediately prior to the second timing TM2, will be called as a first timing TM1.

The controller 7 may, after the second timing TM2, calculate a second time Tt, which is between the first timing TM1 and the second timing TM2, and calculates an absolute value of a difference between the first time Tp and the second time Tt.

The absolute value of the difference between the first time Tp and the second time Tt, and the third time Ta may be used to determine a lift-start timing TM3, at which the movable plate 50 may be moved upward to locate the top-surface level back at a position higher than the lower limit EL1 of the correct range. The lift-start timing TM3 will be described further below.

It may be noted that, theoretically, the second time T1 should be shorter than or at most equal to the first time Tp, and the difference between the first time Tp and the second time Tt should be greater than or equal to zero. However, in manufactured bulk products, due to allowances in dimensions and assembling errors, there may be cases that the difference between the first tie Tp and the second time Tt is smaller than zero (0). In this regard, in order to overcome such errors and determine the lift-start timing TM3 practically, the controller 7 is adapted to use the absolute value of the difference between the first time Tp and the second time Tt.

<Image Reading Action to Original Document Supported on the Document Supporting Surface>

When the image reading apparatus 1 described above reads an image of an original document supported on the document supporting surface 8A, the controller 7 may control the scanning-device driving source 3M in the reader unit 3 to operate the scanning device, which is not shown, to move the reading sensor 3S in the crosswise direction from a read-start position located underneath a leftward edge of the document supporting surface 8A to a read-end position located underneath a rightward edge of the document supporting surface 8A. Meanwhile, the reading sensor 3S may read an image of the original document supported on the document supporting surface 8A. Thereafter, the controller 7 may control the scanning-device driving source 3M in the reader unit 3 to operate the scanning device to move the reading sensor 3S that finished reading in a reverse direction to move from the rightward end to the leftward end and return to a reading-standby position.

<Image Reading Action to Original Document being Conveyed by the Auto Document Feeder>

The image reading apparatus 1 may convey the sheet SH supported on the sheet tray 91 by the auto document feeder 4 and read an image of the sheet SH being conveyed. In particular, the controller 7 may control the scanning-device driving source 3M of the reader unit 3 to operate the scanning device to place the reading sensor 3S at the stationary reading position located underneath the reader surface 8B, as shown in FIG. 3. At this point, the movable plate 50 is located at the origin position.

Next, as shown in FIG. 8, the controller 7 may control the tray-driving source M1 to rotate in the normal direction, causing the link lever 89 to swing upward and the movable plate 50 to move upward from the origin position.

When the signals from the first sensor S1 are switched from the OFF signals to the ON signals, the controller 7 may determine that the top-surface level is at a position higher than the lower limit EL1 of the correct range and control the tray-driving source M1 to stop rotating. While the tray-driving source M1 is stopped, the controller 7 may move the link lever 89 further upward to overrun a small extent to locate the movable plate 50 at a position, at which the height difference between the uppermost one of the sheets SH supported by the sheet tray 91 and the conveyer edge 36E of the conveyer surface 36 may stay within the range to feed the uppermost sheet SH without interference.

Next, the controller 7 may activate the conveyer-driving source M2 and start the sequential conveying action with the conveyer-driving mechanism 70. Meanwhile, an action with the conveyer-driving mechanism 70 to convey solely one of the sheets SH supported by the sheet tray 91 may be regarded as merely conveying the first one of the sheets SH in the sequential conveying action and ending the sequential conveying action thereat; therefore, description for the single, or non-sequential, conveying action is herein omitted.

The controller 7 may drive the feed roller 41, the separator roller 42, the first conveyer roller 43, the second conveyer roller 44, and the ejection roller 47 to rotate and convey the sheets SH supported by the sheet tray 91 one after another.

While the conveyer-driving source M2 is in motion, the transmission-active portion 76 and the transmission-passive portion 77 in the first driving train 71 may repeat contacting and separating from each other. Therefore, as shown in FIG. 8, after the feed roller 41 and the separation roller 42 finishes feeding one of the sheets SH, the feed roller 41 and the separator roller 42 may pause motionless temporarily, and thereafter, the feed roller 41 and the separation roller 42 may resume rotating to feed the next sheet SH. It may be noted that FIG. 8 merely shows the rotating and stopping motions of the feed roller 41; however, the separation roller 42 may rotate and stop as well as the feed roller 41. Therefore, as the sheets SH are fed one after another by the feed roller 41 and the separation roller 42 from the sheet tray 91, a distance may be securely reserved between the sheets SH, e.g., SH1, SH7.

When the sheet SH being conveyed along the conveyer surfaces 36, 39G1, 39G2 passes over the reader surface 8B, as shown in FIG. 4, the controller 7 may control the reading sensor 3S staying still at the stationary reading position to read the image of the sheet SH. The controller 7 may operate the ejection roller 47 and the ejection pinch roller 47P to nip the sheet SH, whose image has been read, to eject the sheet SH at the ejection tray 96.

In the meantime, as shown in FIG. 8, the controller 7 may determine the sheet length LS1 based on the sheet-detection signals SG1 from the second sensor S2. Moreover, based on the sheet length LS1, the controller 7 may calculate the third time Ta and the first time Tp. Thereafter, the controller 7 waits for arrival of the second timing TM2, at which the signals from the first sensor S1 are switched from the ON signals to the OFF signals.

When the second timing TM2 arrives, the controller 7 may determine that the top-surface level is at the lower limit EL1 of the correct range. Thereafter, the controller 7 may calculate the second time Tt and calculates the absolute value of the difference between the first time Tp and the second time Tt.

The controller 7 may determine whether the absolute value of the difference between the first time Tp and the second time Tt is smaller than the third time Ta. Based on the determination, the controller 7 may determine a delay time Td, for which the lift-start timing TM3 to start moving the movable plate 50 upward may be delayed from the second timing TM2.

Figure 9:
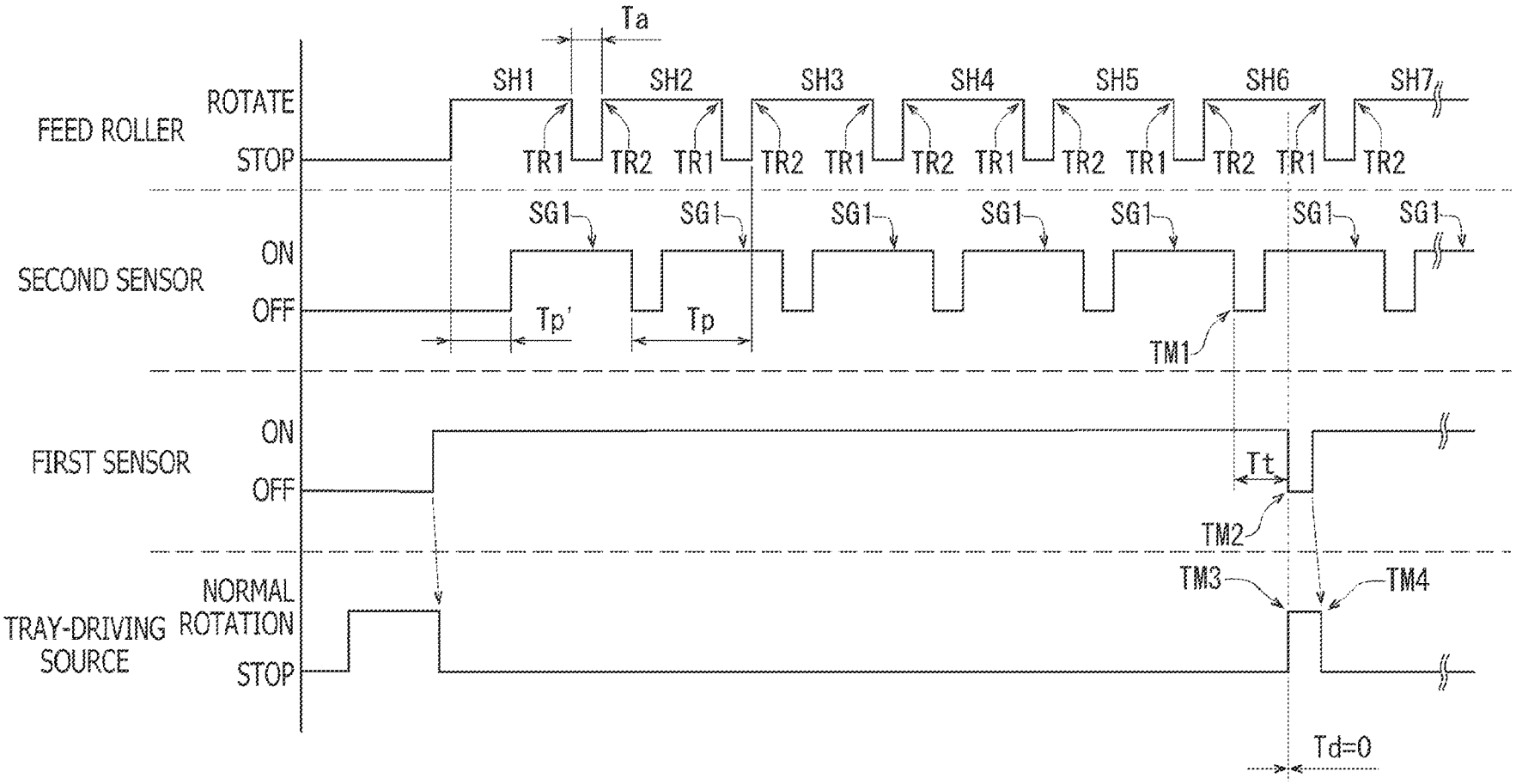
FIG. 9 is another time chart to illustrate timings to move the sheet tray during the sequential conveying action in the image reading apparatus according to the embodiment of the present disclosure.

FIG. 8 illustrates a case, in which the absolute value of the difference between the first time Tp and the second time Tt is smaller than the third time Ta. FIG. 9 illustrates a case, in which the absolute value of the difference between the first time Tp and the second time Tt is greater than or equal to the third time Ta. It may be noted that, in FIG. 8, the second sensor S2 stops outputting the sheet-detection signals SG1 for the fourth sheet SH (SH4) at the first timing TM 1, and in FIG. 9, the second sensor S2 stops outputting the sheet-detection signals SG1 for the fifth sheet SH (SH5) at the first timing TM1. In other words, in FIG. 8, the first timing TM1 corresponds to the sheet SH (SH4), and in FIG. 9, the first timing TM1 corresponds to the sheet SH (SH5).

When the absolute value of the difference between the first time Tp and the second time Tt is smaller than the third time Ta, as shown in FIG. 8, the controller 8 sets a length of the delay time Td to be longer than or equal to the third time Ta. In the present embodiment, for example, the length of the delay time Td may be at least twice as long as the third time Ta.

The delay time Td may be set in an arrangement such that a lift-completion timing TM4, at which the upward movement of the movable plate 50 started moving from the lift-start timing TM3 is completed, should arrive earlier than completion of feeding of the next sheet SH.

When the absolute value of the difference between the first time Tp and the second time Tt is larger than or equal to the third time Ta, on the other hand, as shown in FIG. 9, the controller 8 may set the length of the delay time Td to be zero.

In this arrangement of the delay time Td, the controller 7 performing the sequential conveying action may, after detecting the top-surface level being at the lower limit EL1 of the correct range, delay the lift-start timing TM3, at which the movable plate 50 in the sheet tray 91 starts moving upward, to be later than the timing when the feed roller 41 may resume rotating for feeding the next sheet SH so that the upward movement of the movable tray 50 in the sheet tray 1 may be completed at the lift-completion timing TM4, which is prior to completion of feeding of the next sheet SH. Thereby, the top-surface level may be lifted back to a position higher than the lower limit EL1 of the correct range, and the height difference between the uppermost one of the sheets SH supported by the sheet tray 91 and the conveyer edge 36E of the conveyer surface 36 may be maintained within the correct range to feed the sheets SH correctly.

The time length between the lift-start timing TM3 and the lift-completion timing TM4 may be set within a range around, for example, one second.

The amount of the sheets SH supported by the sheet tray 91 may be reduced to a level as shown in FIG. 5 and further, and when no sheet SH remains on the sheet tray 91, the controller 7 may stop the tray-driving source M1 and the conveyer-driving source M2 and end the image reading action.

The controller 7 controls the scanning-device driving source 3M in the reader unit 3 to operate the scanner device to move the reading sensor 3S to return to the sensor-standby position to finish the image reading operation.

<Benefits>

According to the image reading apparatus 1 in the first embodiment described above, as shown in FIGS. 8 and 9, during the sequential conveying action, after the second timing TM2, at which the first sensor S1 detects the top-surface level being at the lower limit EL1 of the correct range, the controller 7 may determine the delay time Td depending on the circumstance. Thus, the lift-start timing TM3 to start moving the movable plate 50 of the sheet tray 91 upward may be delayed for the delay time Td, as shown in, for example, FIG. 8, so that the movable plate 50 of the sheet tray 91 may complete moving to the higher position at the lift-completion timing TM4, which is prior to completion of feeding of the next sheet SH. In this arrangement, the action to move the movable plate 50, which is performed between the lift-start timing TM3 and the lift-completion timing TM4, may not overlap the rotation-resume timing TR2, at which the feed roller 41 resumes rotating.

Therefore, it is not necessary to extend the third time Ta between the rotation-stop timing TR1 and the rotation-resume timing TR2, in which the feed roller 41 pauses motionless, to wait for the movable plate 50 of the sheet tray 91 to complete moving. Moreover, in this arrangement, when the feed roller 41 resumes rotating, the contact pressure from the feed roller 41 against the uppermost sheet SH may be restrained from changing.

Therefore, according to the image reading apparatus 1 of the first embodiment, the runtime for sequential conveying action may not be increased, and the feed roller 41 may deliver stable feeding performance.

Moreover, the controller 7 of the image reading apparatus 1 may determine the sheet length SL1 based on the sheet detection signals SG1 from the second sensor S2, calculate the first time Tp based on the sheet length LS1, and after the second timing TM2, calculate the second time Tt between the first timing TM1 and the second timing TM2. The controller 7 may determine the delay time Td to delay the lift-start timing TM3 based on the absolute value of the difference between the first time Tp and the second time Tt. Under this control, the controller 7 may delay the lift-start timing TM3 to start moving the movable plate 50 of the sheet tray 91 upward preferably.

Moreover, the controller 7 of the image reading apparatus 1 may calculate the third time Ta based on the sheet length LS1, and when the absolute value of the difference between the first time Tp and the second time Tt is smaller than the third time Ta, the controller 8 may set the length of the delay time Td to be longer than or equal to the third time Ta, or more specifically, at least twice as long as the third time Ta.

Under this control, the controller 7 may delay the lift-start timing TM3 to start moving the movable plate 50 of the sheet tray 91 upward more preferably.

Moreover, according to the image reading apparatus 1 in the first embodiment described above, the conveyer-driving mechanism 70 has the transmission-active portion 76 and the transmission-passive portion 77. The conveying velocity V2 of the sheet SH conveyed by the first conveyer roller 43, the second conveyer roller 44, and the ejection roller 47 is set to be higher than the conveying velocity V1 to convey the sheet SH by the feed roller 41 and the separation roller 42. Therefore, the conveyer-driving mechanism 70 may, without using a device such as, for example, an electromagnetic clutch, perform the series of actions of stopping the rotation of the feed roller 41 after the feed roller 41 completes feeding one of the sheets SH and resuming the rotation of the feed roller 41 for feeding the next one of the sheets SH. Meanwhile, a distance may be securely reserved between the sheets SH being conveyed one after another. Moreover, due to the delay of the lift-start timing TM3, the feed roller 41 may deliver stable feeding performance, and the separation roller 42 may deliver stable separating performance.

Second Embodiment

An image reading apparatus according to a second embodiment may be different from the image reading apparatus 1 in the first embodiment in that the delay time Td is determined in a different procedure, as described below.

The memory 7M stores a section length, from the upstream end of the conveyance guide 30 in the conveying direction D1 to a nipping position between the first conveyer roller 43 and the first pinch roller 43P.

The controller 7 may, with reference to the section length from the upstream end of the conveyance guide 30 to the nipping position, and to the conveying velocity V1, calculate a fourth time Tb, which is a time period between the rotation-resume timing TR2 and a timing when the sheet SH reaches the nipping position between the first conveyer roller 43 and the first pinch roller 43P.

When the absolute value of the difference between the first time Tp and the second time Tt is smaller than the third time Ta, the controller 7 may determine the length of the delay time Td to be greater than or equal to the third time Ta and greater than or equal to the fourth time Tb.

In this arrangement of the second embodiment, the run-time for the sequential conveying action may not be extended while the feed roller 41 may deliver stable feeding performance.

Moreover, under this control, the controller 7 may delay the lift-start timing TM3 to start moving the movable plate 50 of the sheet tray 91 upward more preferably. Furthermore, due to the delay of the lift-start timing TM3, the feed roller 41 may deliver stable feeding performance, and the separation roller 42 may deliver stable separating performance.

Although examples of carrying out the invention has been described, those skilled in the art will appreciate that there are numerous variations and permutations of the sheet conveyer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the separation pad 42A to work with the separation roller 42 may be replaced with a retard roller.

For another example, the conveyer-driving mechanism 70 may not necessarily reserve the distance between the sheets SH being conveyed by the transmission-active portion 76 and the transmission-passive portion 77 in the first driving train 71. For example, the distance between the sheets SH being conveyed may be reserved by a conveyer-driving mechanism, which employs an electromagnetic clutch to convey the sheets SH intermittently.

For another example, the sheet conveyer may not necessarily be applied to the single-functioned image reading apparatus but may be included in a multifunction peripheral machine having a plurality of image processing functions.

What is claimed is:

1. A sheet conveyer, comprising:

a sheet tray configured to support sheets for being fed;

a tray-driving mechanism configured to move the sheet tray vertically;

a conveyance guide configured guide the sheets fed from the sheet tray;

a feed roller configured to feed the sheets supported by the sheet tray along the conveyance guide by rotating;

a conveyer-driving mechanism configured to drive the feed roller, the conveyer-driving mechanism being configured to, for a sequential conveying action to convey a plurality of ones of the sheets supported by the sheet tray sequentially, cause the feed roller to pause after feeding one of the sheets completely and before starting to feed a next one of the sheets;

a first sensor configured to detect whether a top-surface level being a height level of an uppermost one of the sheets supported by the sheet tray is at a lower limit of a correct range for feeding the sheets along the conveyance guide; and a controller configured to control the tray-driving mechanism and the conveyer-driving mechanism, the controller being configured to, during the sequential conveying action for each of the sheets that is fed, when the first sensor detects the top-surface level being at the lower limit of the correct range, delay a lift-start timing, at which the tray-driving mechanism starts moving the sheet tray upward, to be later at least than a timing, at which the feed roller after feeding one of the sheets completely and pausing resumes rotating for feeding the next one of the sheets, and cause the sheet tray to complete moving to a higher position prior to completion of feeding of the next sheet.

2. The sheet conveyer according to claim 1, further comprising:

a second sensor located along the conveyance guide, the second sensor being configured to output sheet-detection signals while detecting one of the sheets being conveyed from a leading edge to a trailing edge along the conveyance guide, wherein the controller is configured to:

based on the sheet-detection signals from the second sensor, determine a sheet length being a length of the one of the sheets being conveyed along the conveyance guide;

based on the sheet length, calculate a first time between a timing, at which the second sensor stops outputting the sheet-detection signals, and a rotation-resume timing, at which the feed roller after pausing resumes rotating;

after detection of the top-surface level being at the lower limit of the correct range by the first sensor, calculate a second time between a first timing, at which the second sensor stopped outputting the sheet-detection signals immediately prior to the detection of the top-surface level being at the lower limit of the correct range, and a second timing, at which the top-surface level being at the lower limit of the correct range was detected by the first sensor; and based on an absolute value of a difference between the first time and the second time, determine the lift-start timing.

3. The sheet conveyer according to claim 2, wherein the controller is configured to:

based on the sheet length, calculate a third time between a rotation-stop timing, at which the feed roller pauses, and the rotation-resume timing; and when the absolute value of the difference between the first time and the second time is smaller than the third time, delay the lift-start timing to be later than the second time for a length longer than or equal to the third time.

4. The sheet conveyer according to claim 3, wherein the controller is configured to delay the lift-start timing to be later than the second time for a length at least twice as long as the third time.

5. The sheet conveyer according to claim 3, further comprising:

a separator configured to be driven by the conveyer-driving mechanism, the separator being configured to separate the sheets fed by the feed roller from one another and convey the sheets separately along the conveyance guide; and a conveyer configured to be driven by the conveyer-driving mechanism, the conveyer being configured to convey the sheets passed from the separator along the conveyance guide, wherein the controller is configured to:

calculate a fourth time between the rotation-resume timing and a timing, at which one of the sheets reaches the conveyer; and delay the lift-start timing to be later than the second time for a length longer than or equal to the third time and longer than or equal to the fourth time.

6. The sheet conveyer according to claim 1, further comprising:

a separator configured to be driven by the conveyer-driving mechanism, the separator being configured to separate the sheets fed by the feed roller from one another and convey the sheets separately along the conveyance guide; and a conveyer configured to be driven by the conveyer-driving mechanism, the conveyer being configured to convey the sheets passed from the separator along the conveyance guide, wherein the conveyer-driving mechanism includes a transmission-active portion and a transmission-passive portion arranged in a path to transmit a driving force to the feed roller and the separator, the conveyer-driving mechanism being configured to drive the feed roller, the separator, and the conveyer in a setting such that a conveying velocity to convey the sheets by the conveyer is higher than a conveying velocity to convey the sheets by the feed roller and the separator;

wherein the transmission-active portion is configured to be driven to rotate about a transmission axis; and wherein the transmission-passive portion is configured to be driven to rotate about the transmission axis, the transmission-passive portion being configured to contact the transmission-active portion along a circumferential direction of the transmission axis, the transmission-passive portion being configured to start rotating passively by being pushed by the transmission-active portion.

* * * * *